US009051766B2

(12) United States Patent
Kuan

(10) Patent No.: US 9,051,766 B2
(45) Date of Patent: Jun. 9, 2015

(54) DOUBLE-ACTION DOOR

(71) Applicant: Hsing-Hua Kuan, Taipei (TW)

(72) Inventor: Hsing-Hua Kuan, Taipei (TW)

( * ) Notice: Subject to any disclaimer, the term of this patent is extended or adjusted under 35 U.S.C. 154(b) by 0 days.

(21) Appl. No.: 14/182,016

(22) Filed: Feb. 17, 2014

(65) Prior Publication Data

US 2014/0157675 A1 Jun. 12, 2014

Related U.S. Application Data

(63) Continuation-in-part of application No. 13/706,555, filed on Dec. 6, 2012, now abandoned.

(51) Int. Cl.

| | |
|---|---|
| ***E05F 11/00*** | (2006.01) |
| ***E05D 15/54*** | (2006.01) |
| *E05F 3/02* | (2006.01) |
| *E05F 3/04* | (2006.01) |
| *E05F 3/16* | (2006.01) |
| *E05F 3/18* | (2006.01) |
| *E05F 3/20* | (2006.01) |
| *E05F 1/10* | (2006.01) |

(52) U.S. Cl.

CPC . *E05D 15/54* (2013.01); *E05F 3/02* (2013.01); *E05F 3/04* (2013.01); *E05F 3/16* (2013.01); *E05F 3/18* (2013.01); *E05F 3/20* (2013.01); *E05F 1/105* (2013.01); *E05Y 2900/132* (2013.01)

(58) Field of Classification Search

CPC ..... E05F 1/105; E05F 1/14; E05F 3/02; E05F 3/04; E05F 3/14; E05F 3/16; E05F 3/18; E05F 3/20; E05F 3/102; E05D 15/54

USPC ..... 49/142, 163, 169, 168, 170, 193, 326, 49/161, 207, 149, 172

See application file for complete search history.

(56) References Cited

U.S. PATENT DOCUMENTS

| | | | | |
|---|---|---|---|---|
| 712,449 | A | 10/1902 | Young | |
| 1,581,776 | A | 4/1926 | Altschul | |
| 1,934,546 | A | 11/1933 | Lewerentz | |
| 3,426,383 | A * | 2/1969 | Pollack et al. | 16/62 |
| 4,054,008 | A * | 10/1977 | Phillips | 49/31 |
| 4,075,734 | A * | 2/1978 | Nagase | 16/58 |
| 4,389,817 | A | 6/1983 | Olberding | |
| 4,583,262 | A | 4/1986 | Werner | |
| 5,048,151 | A * | 9/1991 | Orii et al. | 16/64 |
| 5,535,550 | A | 7/1996 | Yang | |
| 6,526,694 | B1 | 3/2003 | Cosgrove | |
| 7,007,342 | B2 * | 3/2006 | Huang | 16/79 |
| 7,815,023 | B2 * | 10/2010 | Salutzki | 188/322.22 |
| 2013/0000203 | A1 | 1/2013 | Platt | |
| 2014/0157544 | A1 * | 6/2014 | Hellwig | 16/72 |

* cited by examiner

*Primary Examiner* — Katherine Mitchell
*Assistant Examiner* — Abe Massad
(74) *Attorney, Agent, or Firm* — Ming Chow; Sinorica, LLC

(57) ABSTRACT

A double-action door based on two door frames and one door panel of a door-in-door architecture so arranged that the door panel is biasable relative to the inner door frame in a first direction and biasable with the inner door frame relative to the outer door frame in a second direction reversed to the first direction subject to the functioning of a bi-directional door closer.

9 Claims, 17 Drawing Sheets

5

DOUBLE-ACTION DOOR

CROSS-REFERENCES TO RELATED APPLICATION

The present invention is a continuation-in-part of U.S. patent application Ser. No. 13/706,555 filed on Dec. 6, 2012.

BACKGROUND OF THE INVENTION

1. Field of the Invention

The present invention relates to door technology and more particularly, to a double-action door having wide open angle and bi-directional opening characteristics.

2. Description of the Related Art

A door can be used as a normal-open partition (e.g., for easy access) or normal-close partition (e.g., for access control) in a public place of a building.

In time of emergency, an escapee normally will push a closed door panel intuitively instead of pulling it. Technically, providing bi-directional escape route and keeping a fire door closed are requisite tasks to ensure a high level of safety.

Single-action and double-action doors are commercially available. A single-action door can simply be opened in one particular direction. A double-action door can be opened in either of two reversed directions. However, due to the limitation of the turning angle of the hinges between the door frame and the door panel, the opening angle of the door panel of a double-action door cannot be widely opened, for example, through 180 degrees.

SUMMARY OF THE INVENTION

The present invention has been accomplished under the circumstances in view. It is therefore the main object of the present invention to provide a double-action door, which provides a door-in-door structure with a small door in a large door, allowing the door panel to be opened in either of two reversed directions subject to the functioning of a bi-directional door closer.

To overcome conventional technical problems, the invention provides a double-action door of a door-in-door structure defining a large door and a small door in the large door. Thus, the double-action door can be opened in either of two reversed directions, providing a bi-directional escape route and keeping in a normally closed condition for fire protection.

The double-action door of the invention eliminates the drawbacks of conventional double-action doors that provide a limited door panel turning angle and can simply allow the door panel to be opened in either "Push" or "Pull" manner, i.e., the double-action door allows the door panel to be opened in a large angle by a push action or a pull action.

To achieve the objects of the present invention, the double-action door is based on the architecture of two door frames and one door panel. This double-action door is a door-set structure comprising an outer door frame, an inner door frame hinged to the inside of the outer door frame and biasable relative to the outer door frame in one direction, and a door panel hinged to the inner door frame and biasable relative to the inner door frame in a reversed direction. Subject to the reversed arrangement of the hinges between the outer door frame and the inner door frame and the hinges between the inner door frame and the door panel, the double-action door can be opened in either of two reversed directions in a large angle, for example, 180 degrees. Therefore the double-action door is practical for use as an escape door or fire door.

Further, a bi-directional door closer is mounted in the inner door frame and coupled between the outer door frame and the door panel for buffering the closing movement of the door panel and for enabling the door panel to be opened in either of two reversed directions.

Further, two double-action doors can be symmetrically arranged together, forming a double-swing double-action combination door.

DETAILED DESCRIPTION OF THE PREFERRED EMBODIMENT

Figure 1:
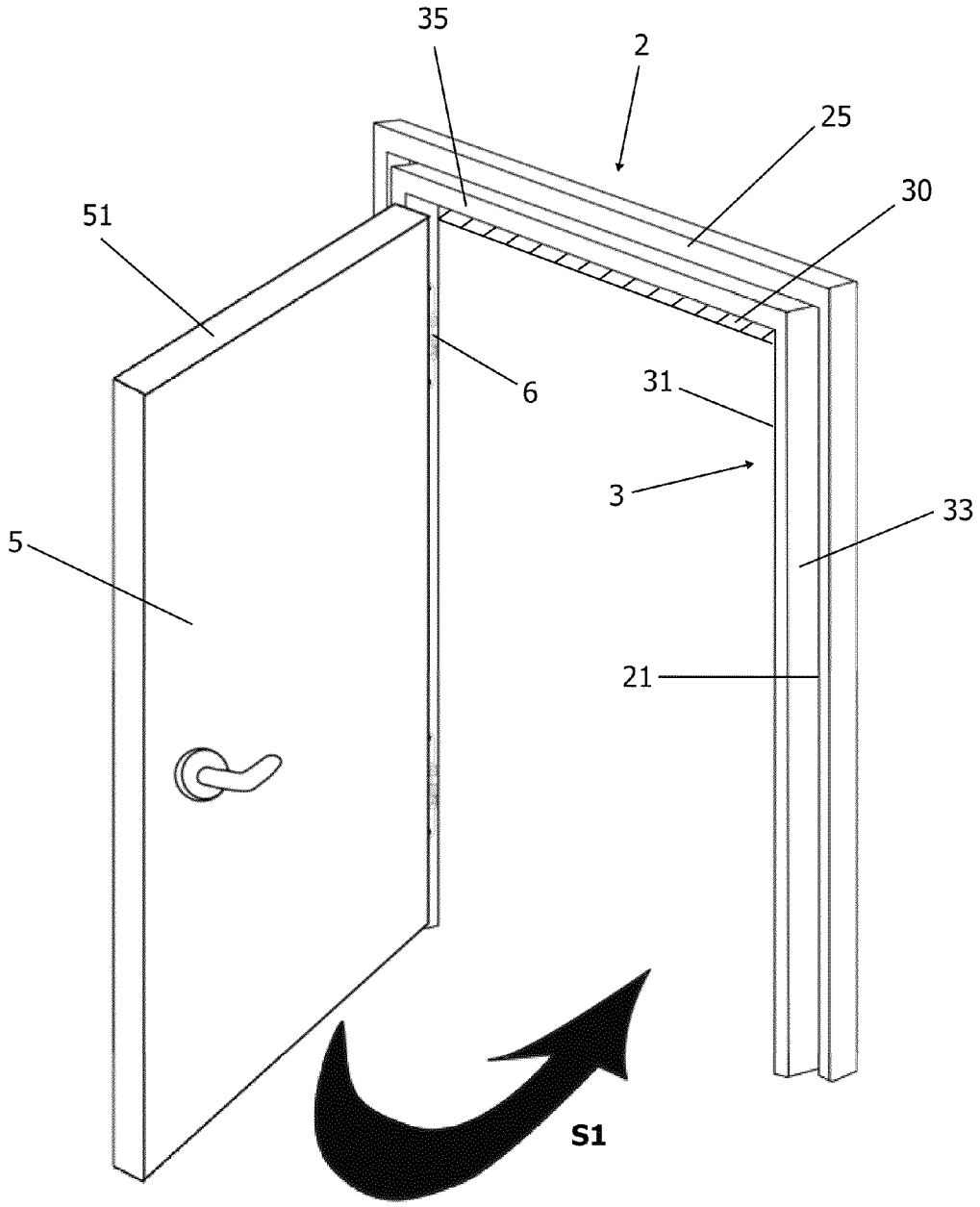
FIG. 1 is a schematic elevational view illustrating an operation status of a double-action door in accordance with a first embodiment of the present invention.
Figure 2:
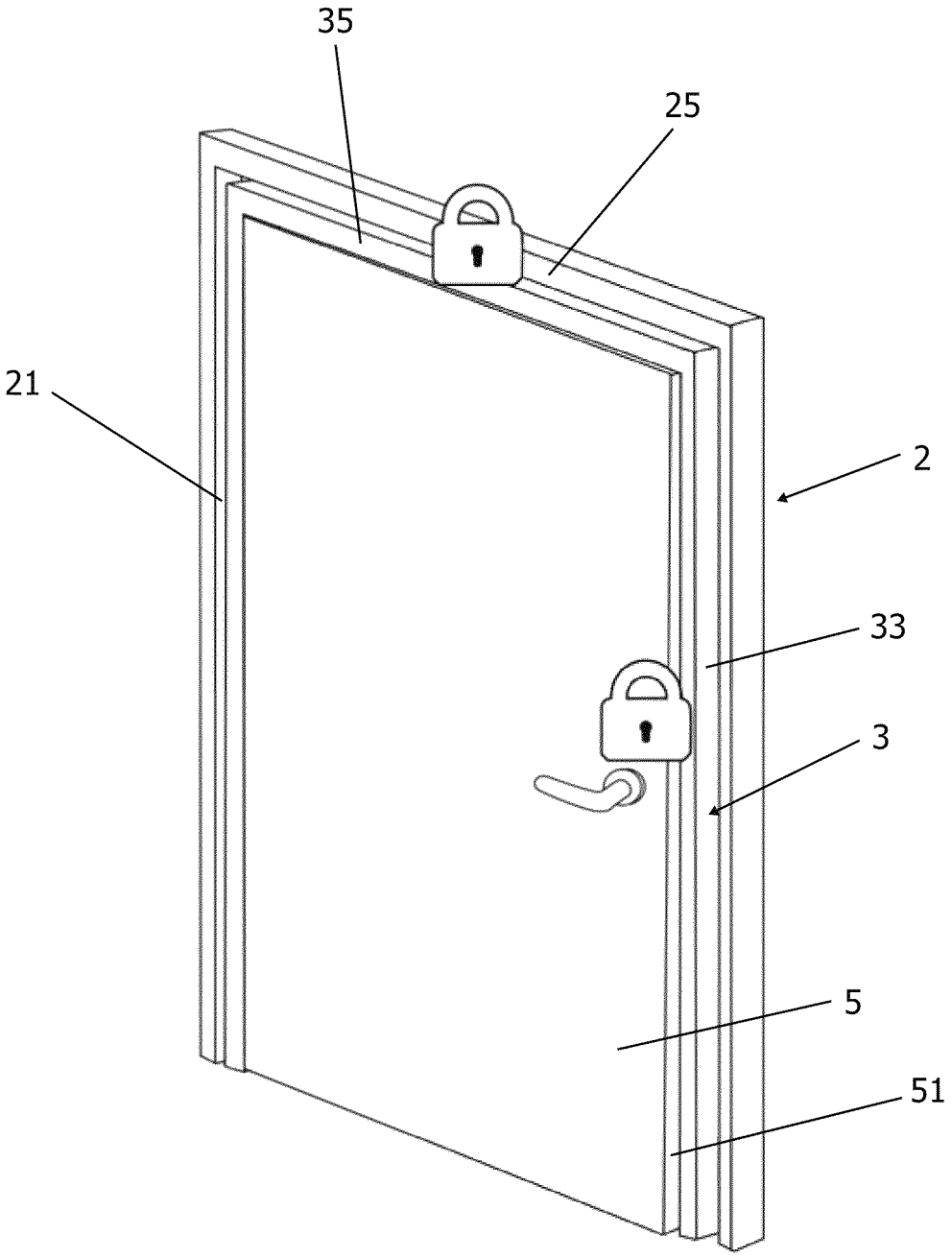
FIG. 2 is an elevational view of the double-action door in accordance with the first embodiment of the present invention.
Figure 3:
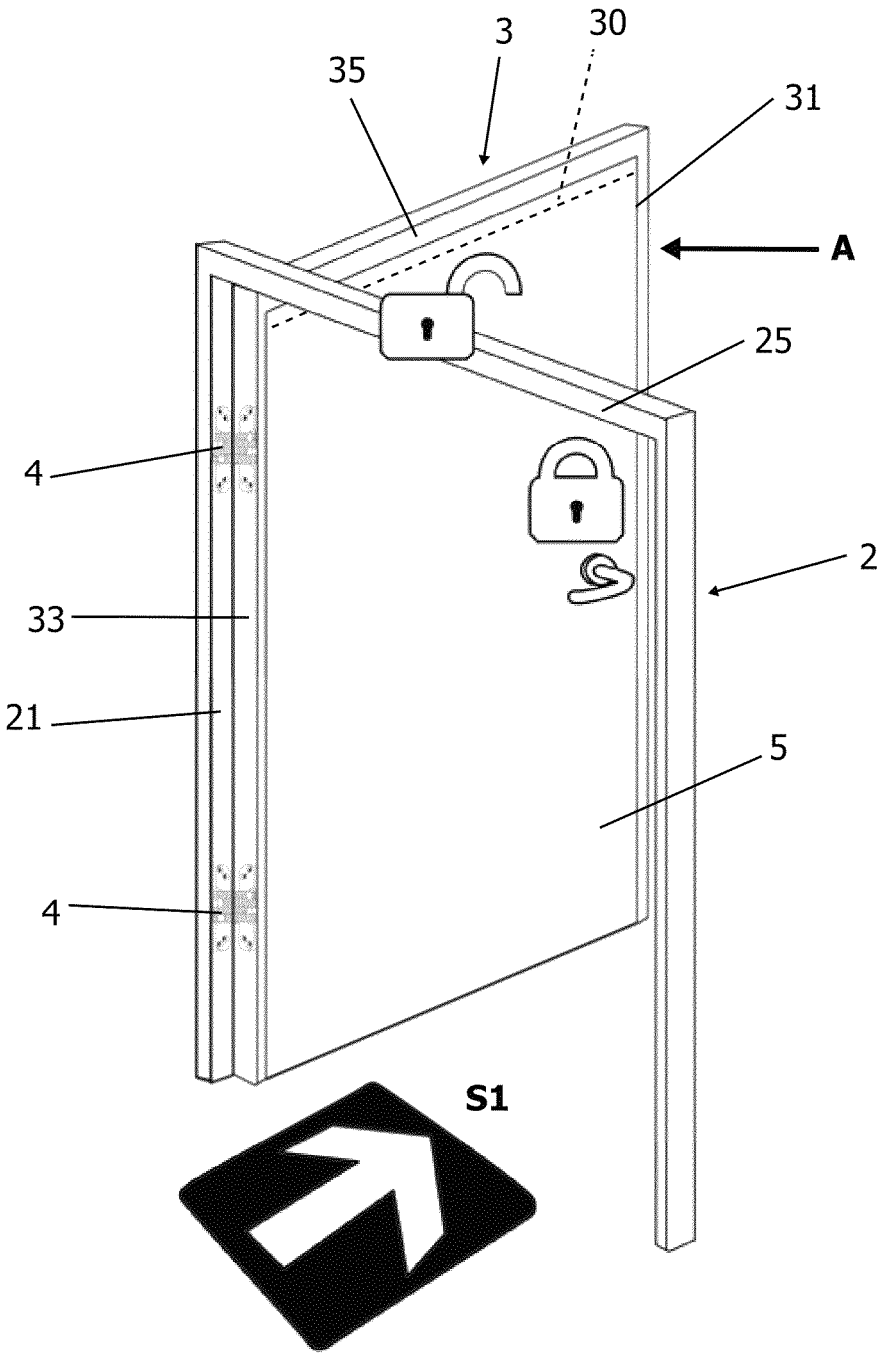
FIG. 3 is a schematic applied view of the first embodiment of the present invention, illustrating the door panel and the inner door frame biased relative to the outer door frame from a close position toward an open position.
Figure 4:
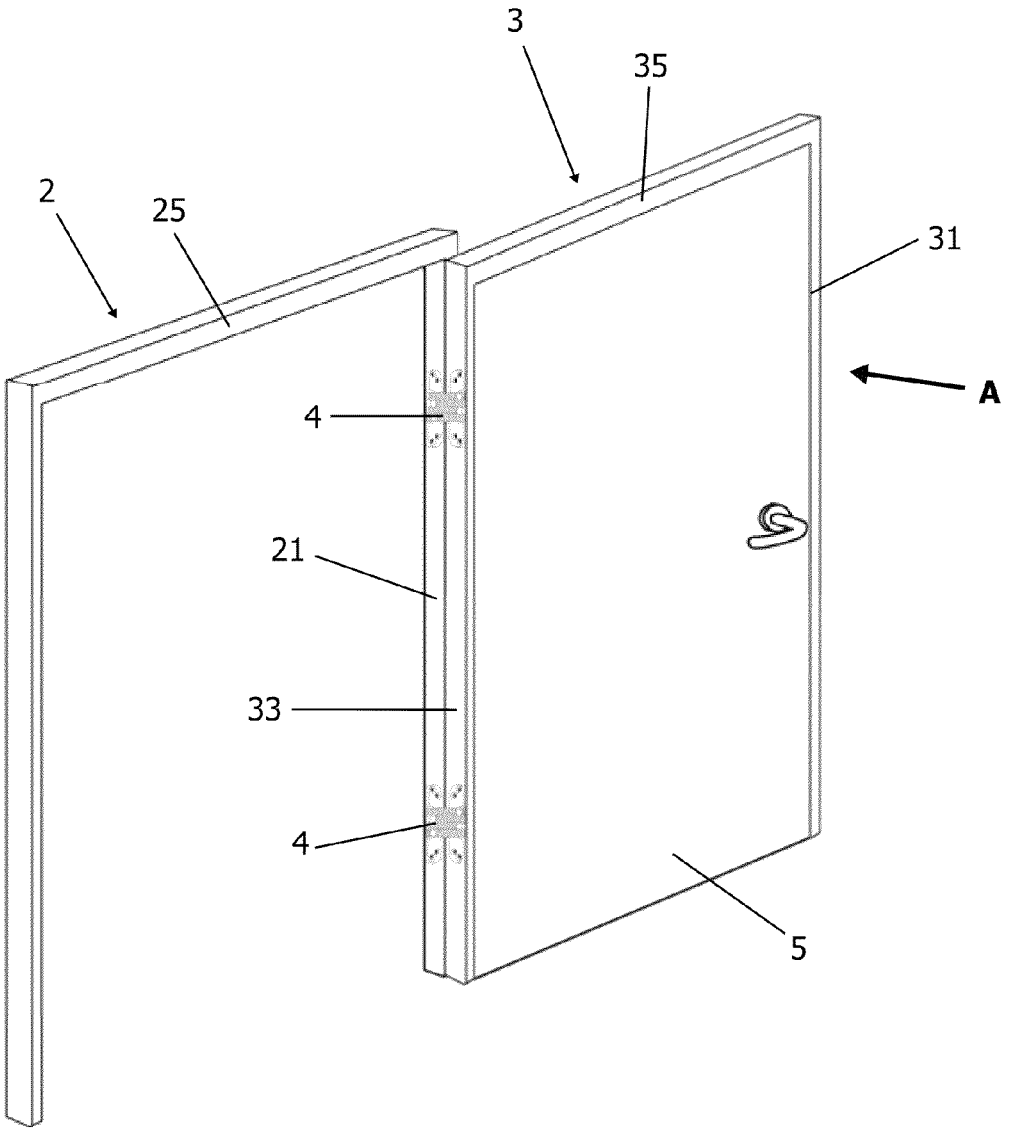
FIG. 4 corresponds to FIG. 3, illustrating the door panel and the inner door frame biased relative to the outer door frame from the close position to the open position through 180 degrees.
Figure 5:
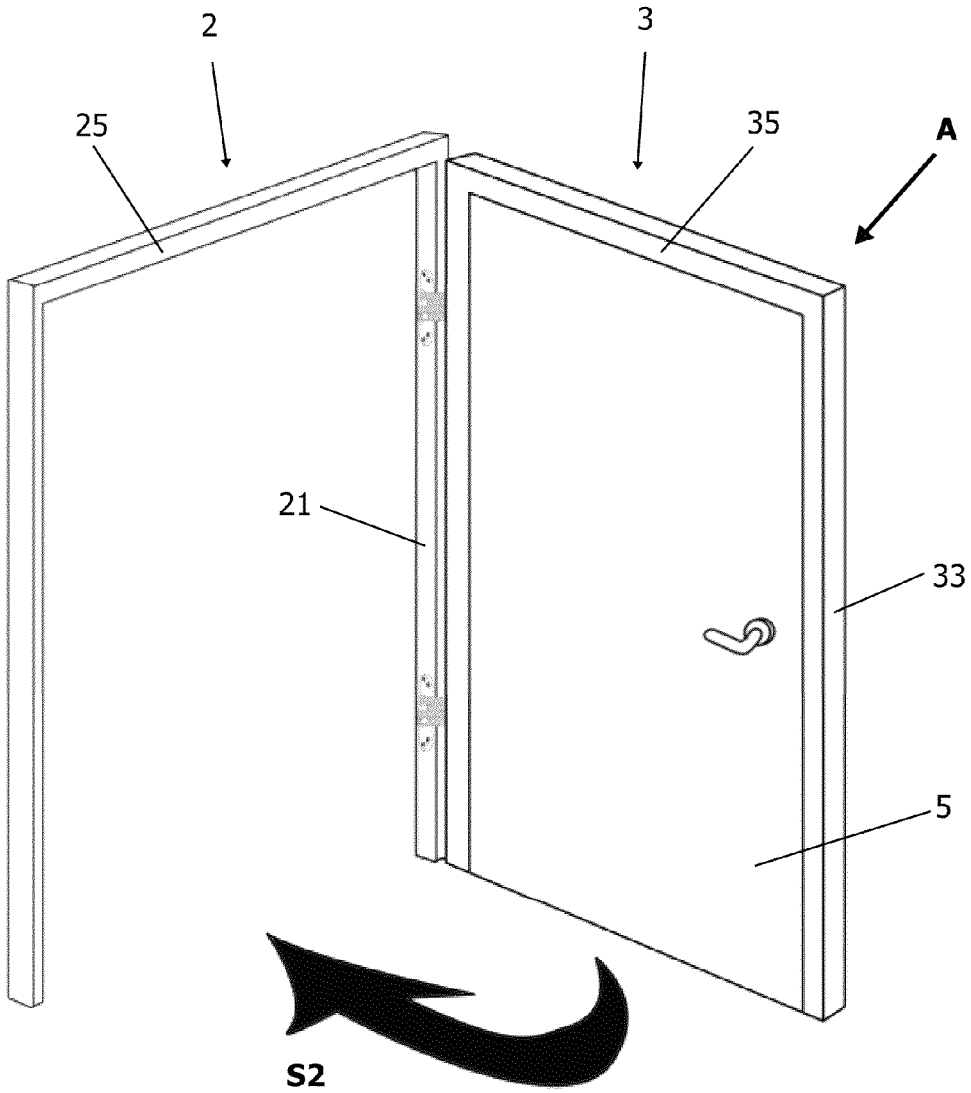
FIG. 5 corresponds to FIG. 5, illustrating the door panel and the inner door frame biased relative to the outer door frame in the second direction (I).
Figure 6:
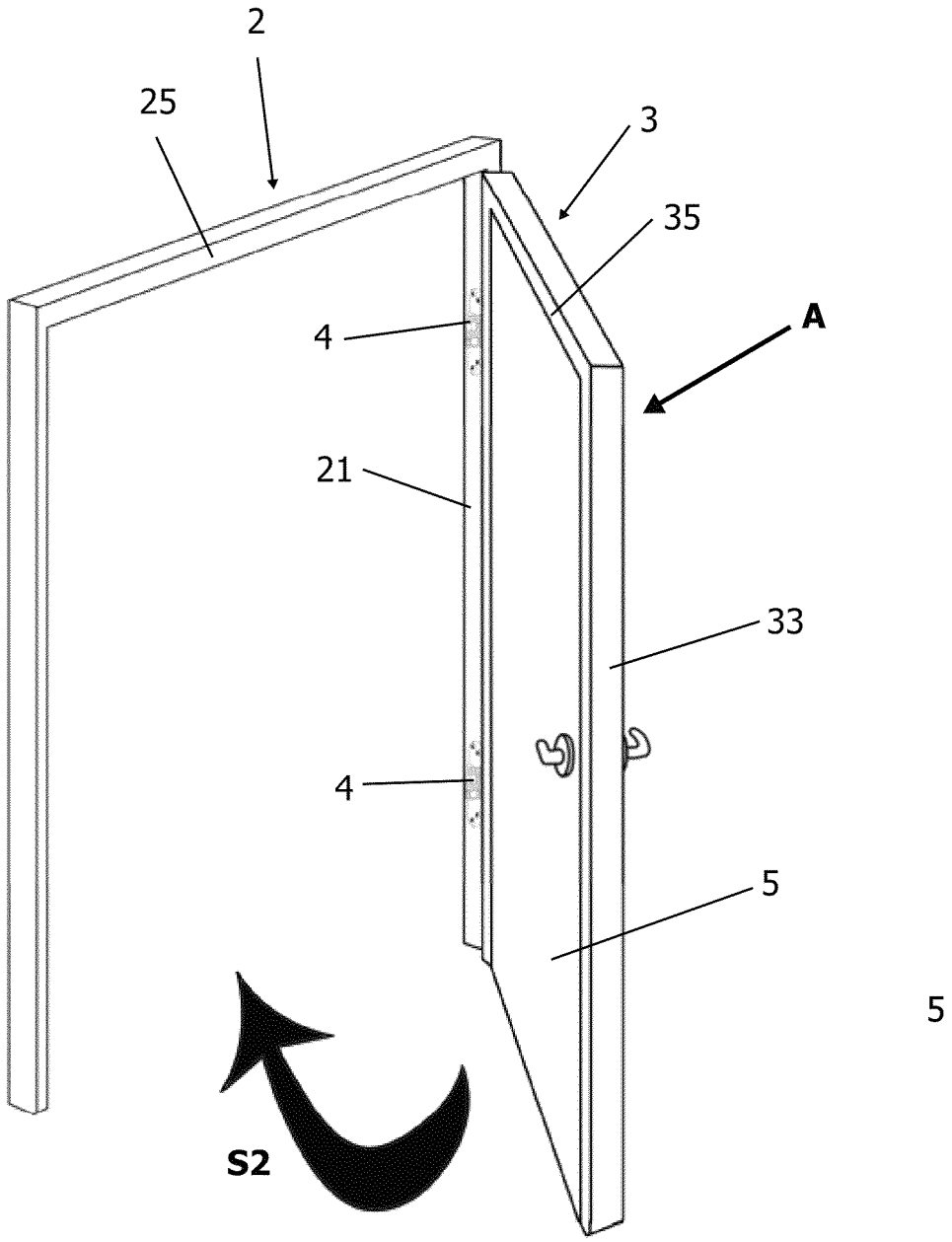
FIG. 6 corresponds to FIG. 5, illustrating the door panel and the inner door frame biased relative to the outer door frame in the second direction (II).
Figure 7:
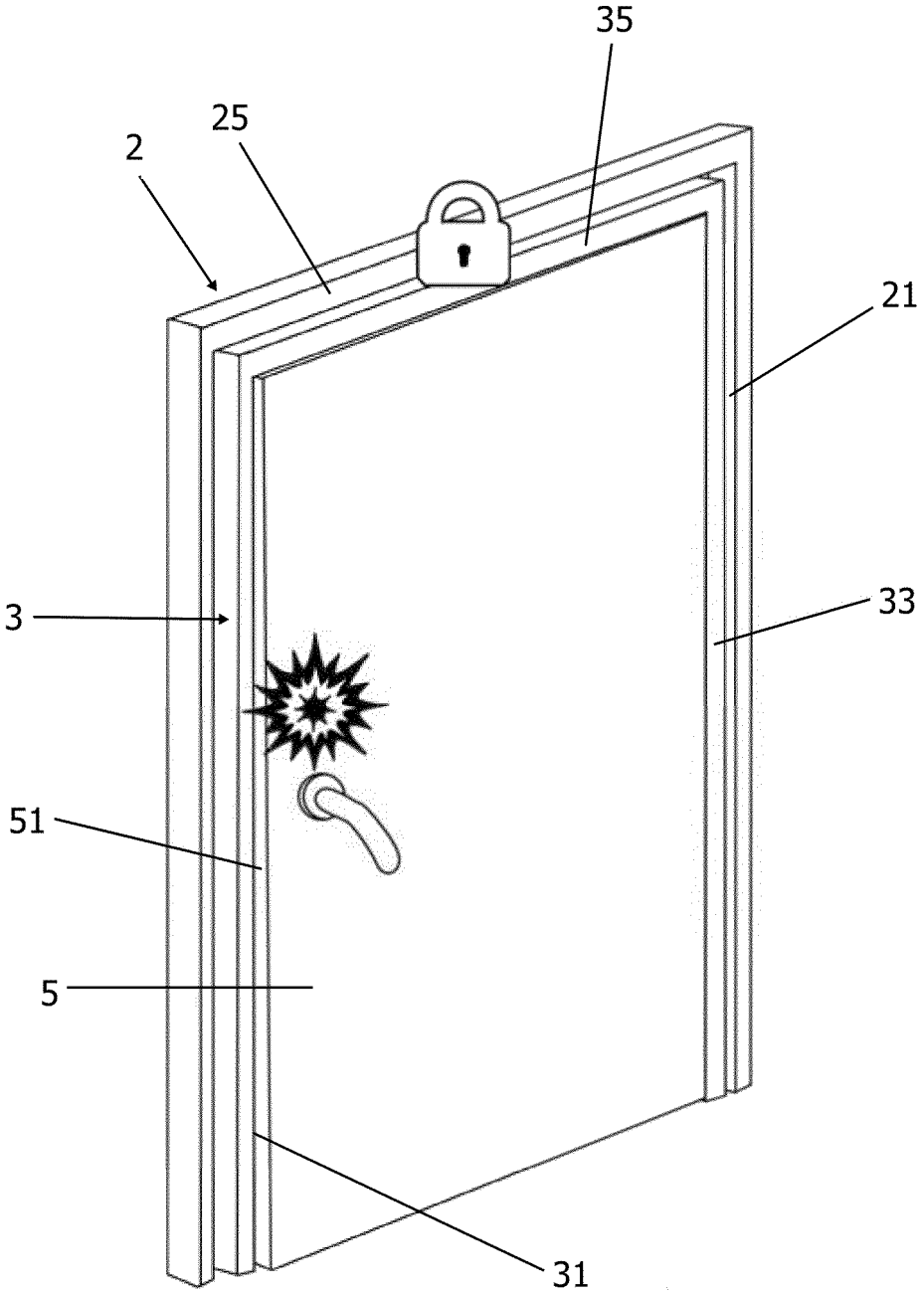
FIG. 7 corresponds to FIG. 5, illustrating the door panel and the inner door frame biased relative to the outer door frame in the second direction (III).
Figure 8:
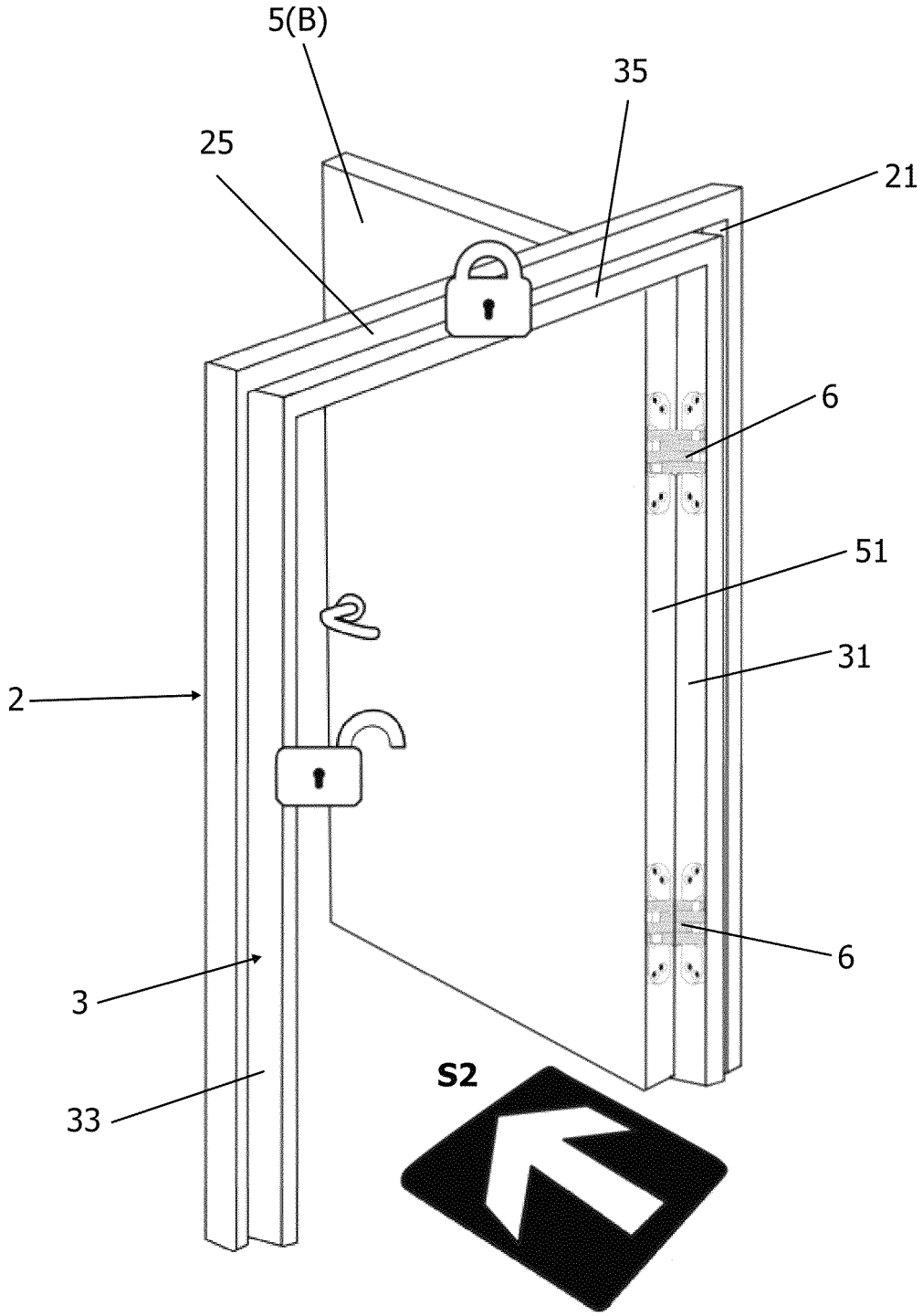
FIG. 8 is a schematic applied view of the first embodiment of the present invention, illustrating the door panel biased relative to the inner door frame and the outer door frame from a close position toward an open position.

Referring to FIGS. 1-8, a double-action door in accordance with the present invention is shown. The double-action door comprises an outer door frame 2 defining an inner edge 21, an inner door frame 3 defining an inner edge 31 and an outer edge 33 opposite to the inner edge 31 and being smaller than the inner edge 21 of the outer door frame 2, at least one, for example, two first hinges 4 connected between the outer door frame 2 and the inner door frame 3 at different elevations for allowing the inner door frame 3 to be biased relative to the outer door frame 4 in a first direction S1 between a close position and an open position, a door panel 5 defining an outer edge 51 being smaller than the inner edge 31 of the inner door frame 3, at least one, for example, two second hinges 6 connected between the inner door frame 3 and the door panel 5 for allowing the door panel 5 to be biased relative to the inner door frame 3 in a second direction S2 reversed to the first direction S1 between a close position and an open position.

Referring to FIG. 3 again, the second hinges 6 prohibit the door panel 5 from being biased relative to the inner door frame 3 in the first direction S1, and allow the door panel 5 to be moved with the inner door frame 3 relative to the outer door frame 2 in the first direction S1 to open a large door A.

Referring to FIG. 8 again, the door panel 5 can be biased relative to the inner door frame 3 in the second direction S2 reversed to the first direction S1 to open a small door B.

Based on the aforesaid arrangement for allowing the large door A to be opened in the first direction S1 or the small door B to be opened in the second direction S2, the invention achieves a double action for outward or inward opening (leftward or rightward opening).

Referring to FIGS. 1 and 3 again, the inner door frame 3 further comprises a stop plate 30 covering a part, for example, the upper part of the inner edge 31 of the inner door frame 3 so that a corresponding part of the door panel 5 can be stopped against the stop plate 30 and moved with the inner door frame 3 in the first direction S1 steadily.

When compared to conventional door structures, the invention uses reversed hinges to couple the outer door frame 2, the inner door frame 3 and the door panel 5, forming a door-indoor architecture that is substantially a unique door-set structure of one frame with two door panels. This door-set structure defines a large door A, and a small door B in the large door A, wherein the inner door frame 3 and the door panel 5 constitute the large door A that can be turned relative to the outer door frame 2 between an open position and a close position in the first direction S1; the door panel 5 constitutes the small door B that can be turned relative to the inner door frame 3 between an open position and a close position in the second direction S2 reversed to the first direction S1. Thus, the double-action door of the present invention can be opened in a large angle in either of two reversed directions, achieving the functions of an emergency exit and a fire escape.

When compared to a conventional double-action door that limits the turning angle of the door panel, the invention allows the door panel to be biased through 180 degrees. When the double-action door of the present invention is used as an entrance door, interior door, access door or fire door in a building, it can work as a left-handed door as well as a right-handed door.

Further, the first hinges 4 or second hinge 6 are buffer hinges having gear buffer means, hydraulic buffer means, spring buffer means, pneumatic buffer means, friction buffer means, or any of their combinations mounted therein for enabling the large door or small door to be automatically returned to the close position after having been opened, or buffering the moving speed of the door panel to reduce noises.

Figure 9:
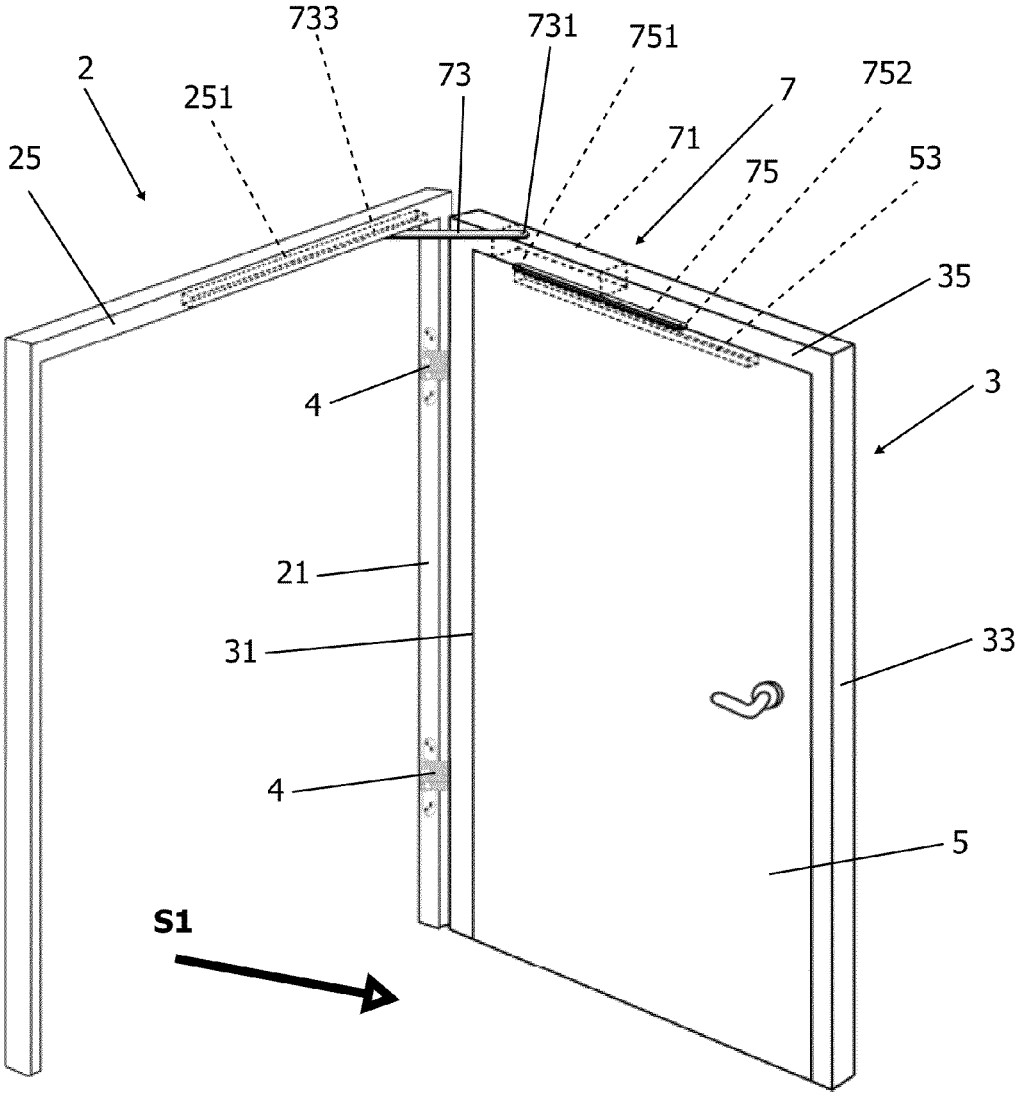
FIG. 9 is a schematic perspective view of a double-action door in an open position in accordance with a second embodiment of the present invention.
Figure 10:
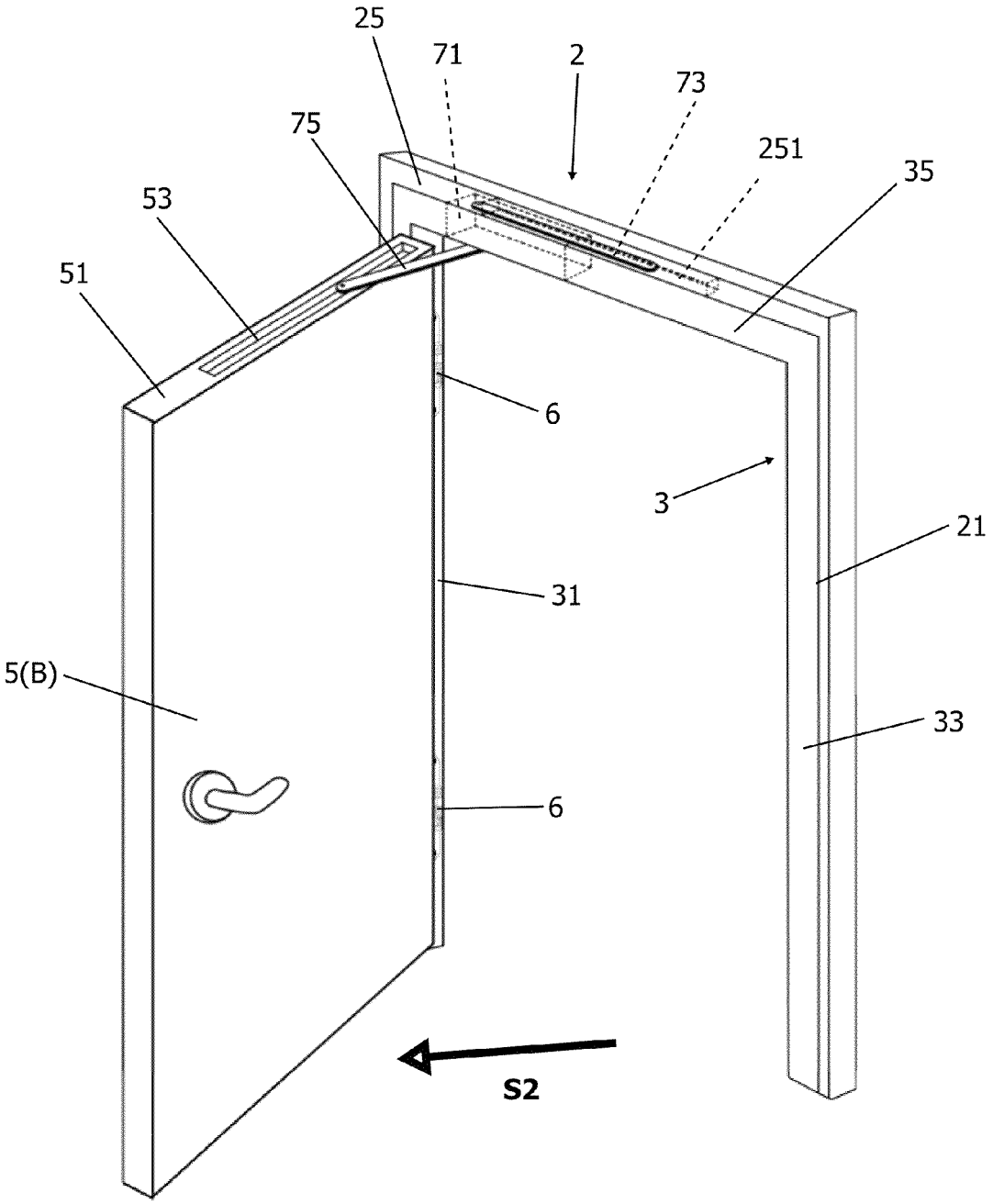
FIG. 10 is a schematic drawing of the second embodiment of the present invention, illustrating the door panel biased relative to the inner door frame and the outer door frame in the second direction from the close position toward the open position.
Figure 11A:
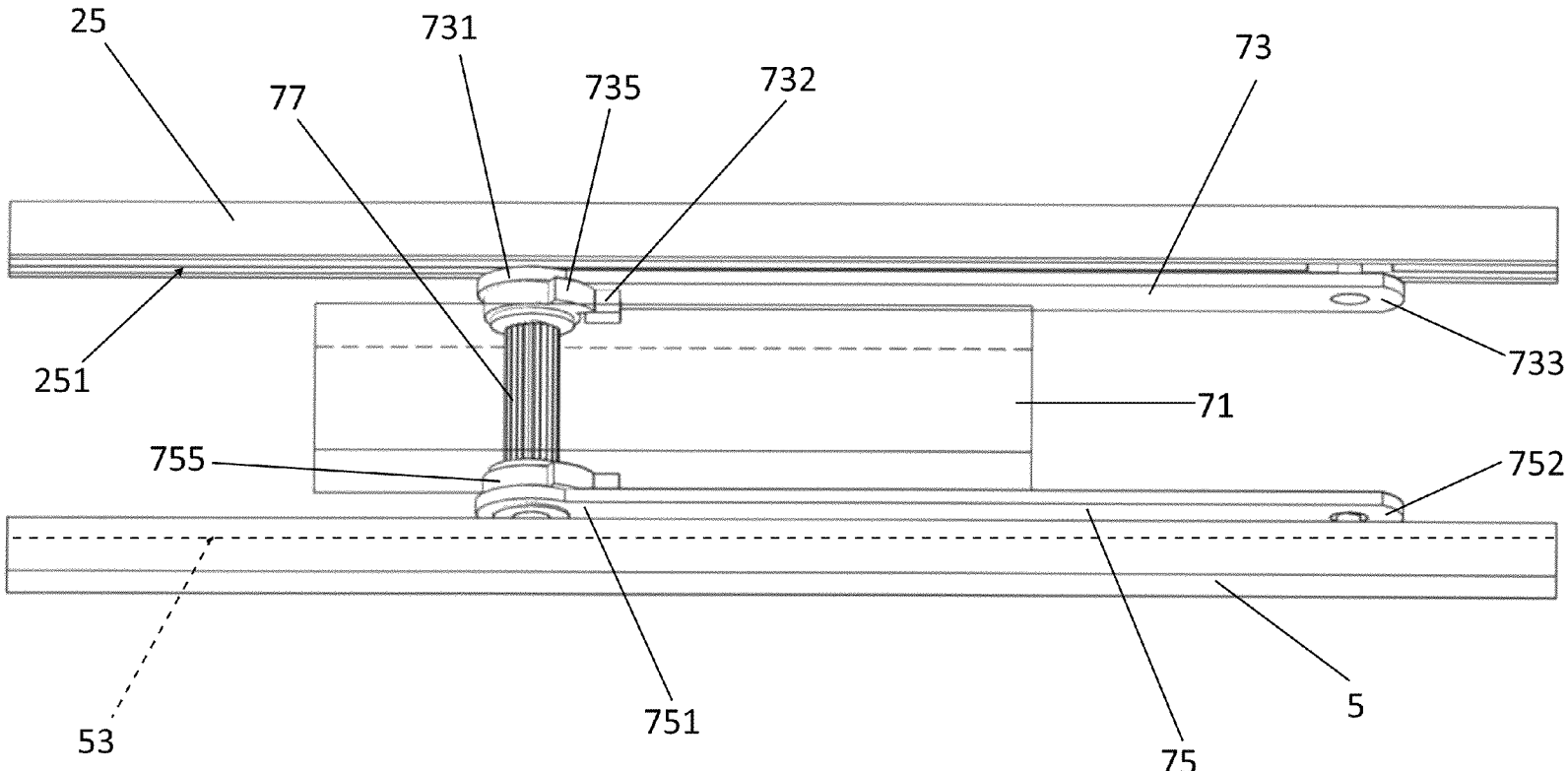
FIG. 11A is a schematic drawing illustrating the structure of the bi-directional door closer of the double-action door in accordance with the second embodiment of the present invention.
Figure 11B:
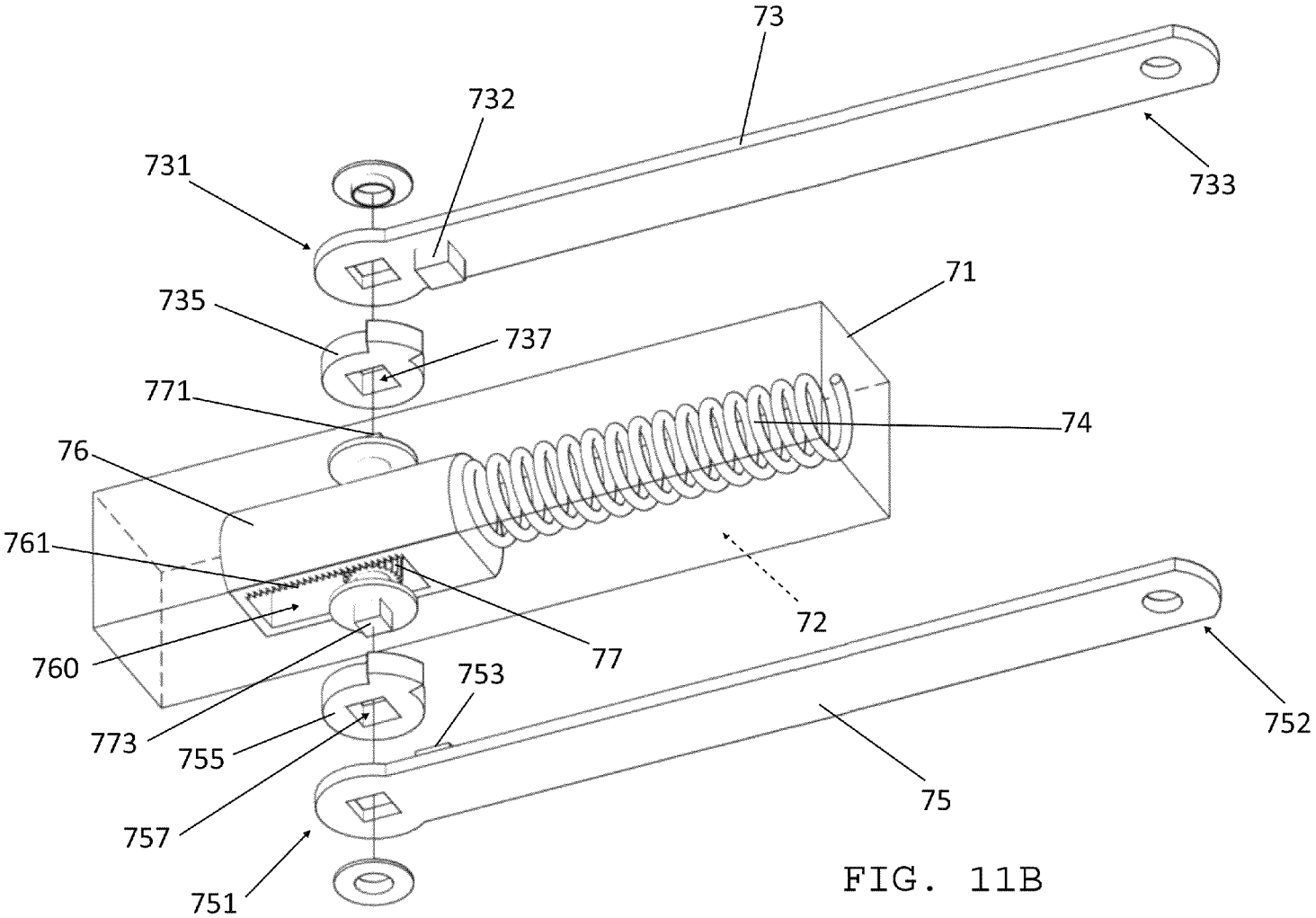
FIG. 11B is an exploded view of the bi-directional door closer of the double-action door in accordance with the second embodiment of the present invention.

Referring to FIGS. 9 and 10, a double-acting door in accordance with a second embodiment of the present invention is shown. The double-action door of this second embodiment comprises an outer door frame 2, an inner door frame 3, at least one, for example, two first hinges 4, a door panel 5, at least one, for example, two first second hinges 6, and a bi-directional door closer 7. The outer door frame 2 comprises an outer door frame inner edge 21 and a first top rail 25 at an upper side of the outer door frame inner edge 21. The inner door frame 3 comprises an inner door frame inner edge 31 (see FIG. 10), an inner door frame outer edge 33 at an upper side of the inner door frame inner edge 31, and a second top rail 35 at a top side relative to the inner door frame inner edge 31. The inner door frame outer edge 33 is smaller than the outer door frame inner edge 21. The two first hinges 4 are connected between the outer door frame 2 and the inner door frame outer edge 33 at different elevations for enabling the inner door frame 3 to be turned with the door panel 5 relative to the outer door frame inner edge 21 in the first direction S1 between an open position and a close position (see FIG. 9). The door panel 5 comprising a door panel outer edge 51 smaller than the inner door frame inner edge 31. The two second hinges 6 are connected between the inner door frame 3 and the door panel outer edge 51 for enabling the door panel 5 to be turned relative to the inner door frame inner edge 31 in a second direction S2 reversed to the first direction S1 between an open position and a close position to form a door-in-door structure. The bi-directional door closer 7 comprises a casing 71 mounted in the second top rail 35, a first arm 73 coupled to one side of the casing 71 and turnable in the first direction S1, and a second arm 75 coupled to an opposite side of the casing 71 and turnable in the second direction S2 reversed to the first direction S1.

Further, the first arm 73 defines a first front end 731 pivotally coupled to one side of the casing 71, and a first rear end 733 coupled to the first top rail 25. The second arm 75 defines a second front end 751 pivotally coupled to the opposite side of the casing 71, and a second rear end 752 coupled to the door panel 5.

In this embodiment, the first top rail 25 defines a first sliding groove 251. The first rear end 733 of the first arm 73 is slidably coupled to the first sliding groove 251. The door panel 5 defines a second sliding groove 53. The second rear end 752 of the second arm 75 is slidably coupled to the second sliding groove 53.

Thus, the inner door frame 3 and the door panel 5 constitute a large door that can be opened from the outer door frame 2 in the first direction S1 or closed thereon; the door panel 5 can work as a small door and be biased relative to the inner door frame 3 in the second direction S2 reversed to the first direction S1 between open and close positions.

When compared to the aforesaid first embodiment, this second embodiment is characterized in the bi-directional door closer 7 that can buffer the speed and return the door panel to the close position. The first rear end 733 of the first arm 73 is movably coupled to the first top rail 25, enabling the bi-directional door closer 7 to buffer the inner door frame 3 and the door panel 5 when they are moved in the first direction S1 between the open position and the close position. The second rear end 752 of the second arm 75 is movably coupled to the door panel 5, enabling the bi-directional door closer 7 to buffer the door panel 5 when the door panel 5 is moved in the second direction S2 between the open position and the close position.

Referring to FIGS. 11A, 11B, 12A, 12B, 12C and 12D, the bi-directional door closer 7 further comprises a shaft wheel 77 rotatably mounted in the casing 71, a track chamber 72 defined in the casing 71, a spring member 74 mounted in the track chamber 72 and stopped against one end wall of the casing 71, and a sliding block 76 stopped against an opposite end of the spring member 74 inside the track chamber 72 and movable linearly relative to the shaft wheel 77. The sliding block 76 comprises a toothed rail 761 movably meshed with the shaft wheel 77. As illustrated, the sliding block 76 further comprises an elongated slot 760 cut through opposing top and bottom sides thereof. The toothed rail 761 is longitudinally disposed at one lateral side of the elongated slot 760. The shaft wheel 77 is rotatably mounted in the casing 71 and inserted through the elongated slot 760 and meshed with the toothed rail 761, having opposing top end 771 and bottom end 773 thereof respectively protruded over the opposing top and bottom sides of the casing 71.

The bi-directional door closer 7 further comprises a first cam 735 and a second cam 755. The first cam 735 is fixedly mounted at the top end 771 of the shaft wheel 77. The second cam 755 is fixedly mounted at the bottom end 773 of the shaft wheel 77.

The first arm 73 further comprises a first stop block 732 located at the first front end 731. The first cam 735 further comprises a first axle hole 737 fastened to the top end 771 of the shaft wheel 77. The first front end 731 of the first arm 73 is rotatably coupled to the top end 771 of the shaft wheel 77 adjacent to the first cam 735. Thus, the first cam 735 and the first stop block 732 are kept in parallel, and can be engaged together or moved apart.

The second arm 75 further comprises a second stop block 753 located at the second front end 751. The second cam 755 further comprises a second axle hole 757 fastened to the bottom end 773 of the shaft wheel 77. The second front end 751 of the second arm 75 is rotatably coupled to the bottom end 773 of the shaft wheel 77 adjacent to the second cam 755. Thus, the second cam 755 and the second stop block 753 are kept in parallel, and can be engaged together or moved apart.

Figure 12A:
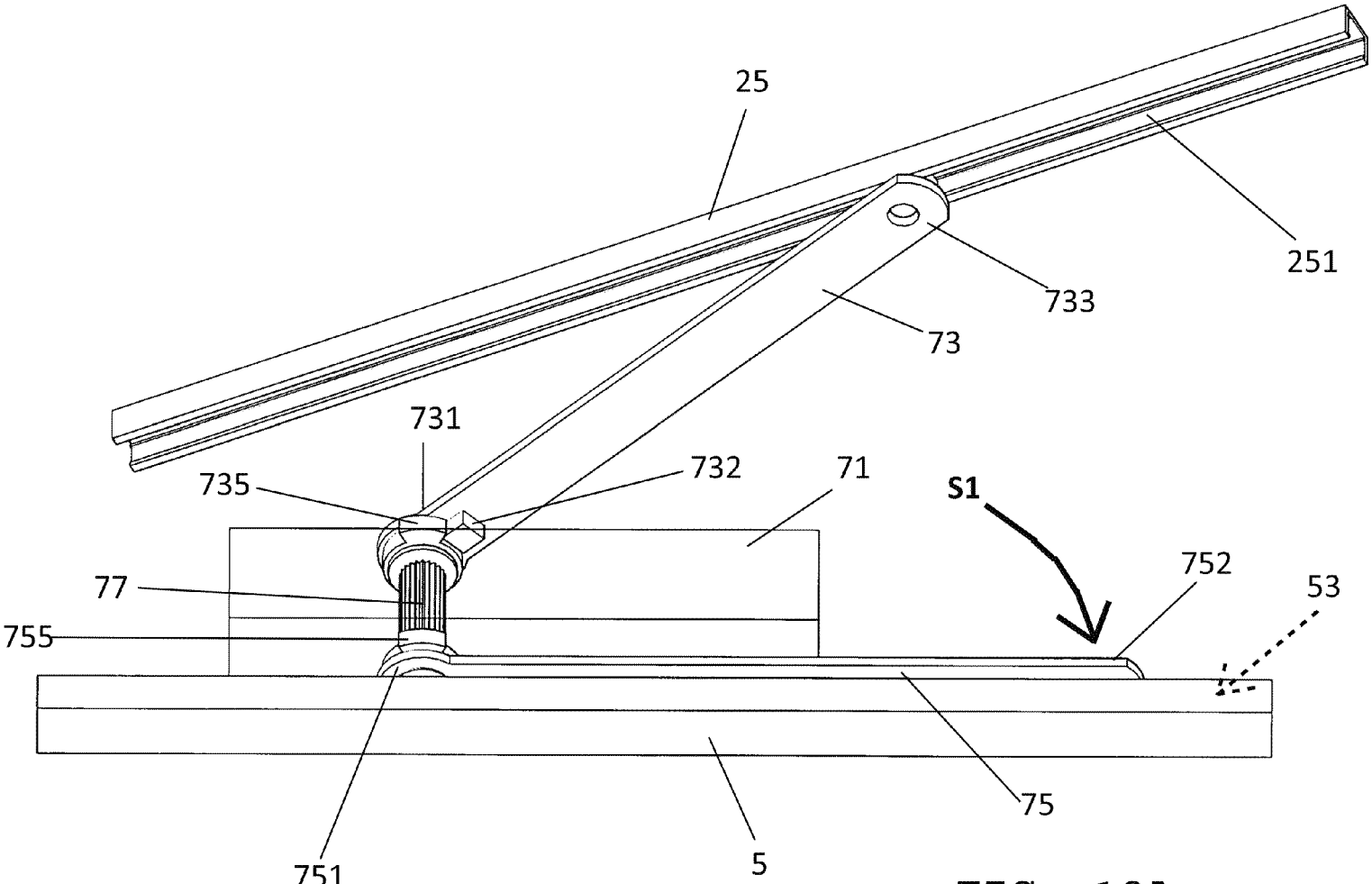
FIG. 12A is a schematic drawing of the second embodiment of the present invention, illustrating the operation of the bi-directional door closer (I).
Figure 12B:
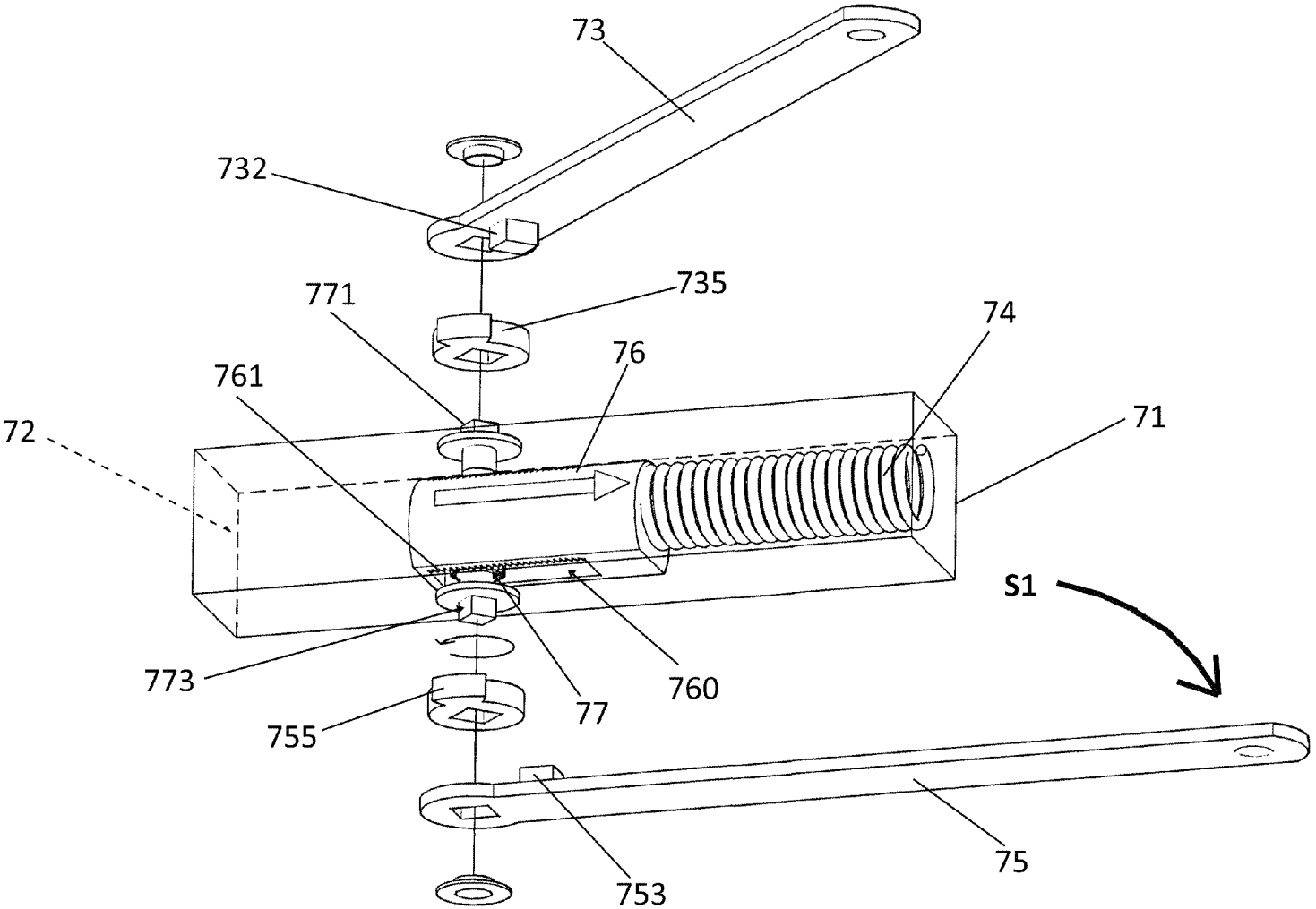
FIG. 12B is a schematic drawing of the second embodiment of the present invention, illustrating the operation of the bi-directional door closer (II).

Referring to FIGS. 12A and 12B, as stated above, the first cam 735 and the second cam 755 are respectively connected to the shaft wheel 77 at two opposite sides in a coaxial manner for synchronous rotation. Thus, when the user opens the inner door frame 3 and the door panel 5 (see also FIG. 9) in the first direction S1, the front stop block 732 of the first arm 73 is forced to stop against (engage with) the first cam 735. At this time, the shaft wheel 77 is synchronously rotated with the first cam 735 in the clockwise direction to move the toothed rail 761, forcing the sliding block 76 to compress the spring member 74, and thus the spring member 74 is forced to accumulate potential energy. At the same time, the second cam 755 is disengaged from the second stop block 753, and therefore the door panel 5 is kept at the inner side of the inner door frame 3. When closing the inner door frame 3 and the door panel 5 at this time, the spring member 74 releases the accumulated potential energy to push the inner door frame 3 and the door panel 5 back to the outer door frame 2 to close the passage.

Figure 12C:
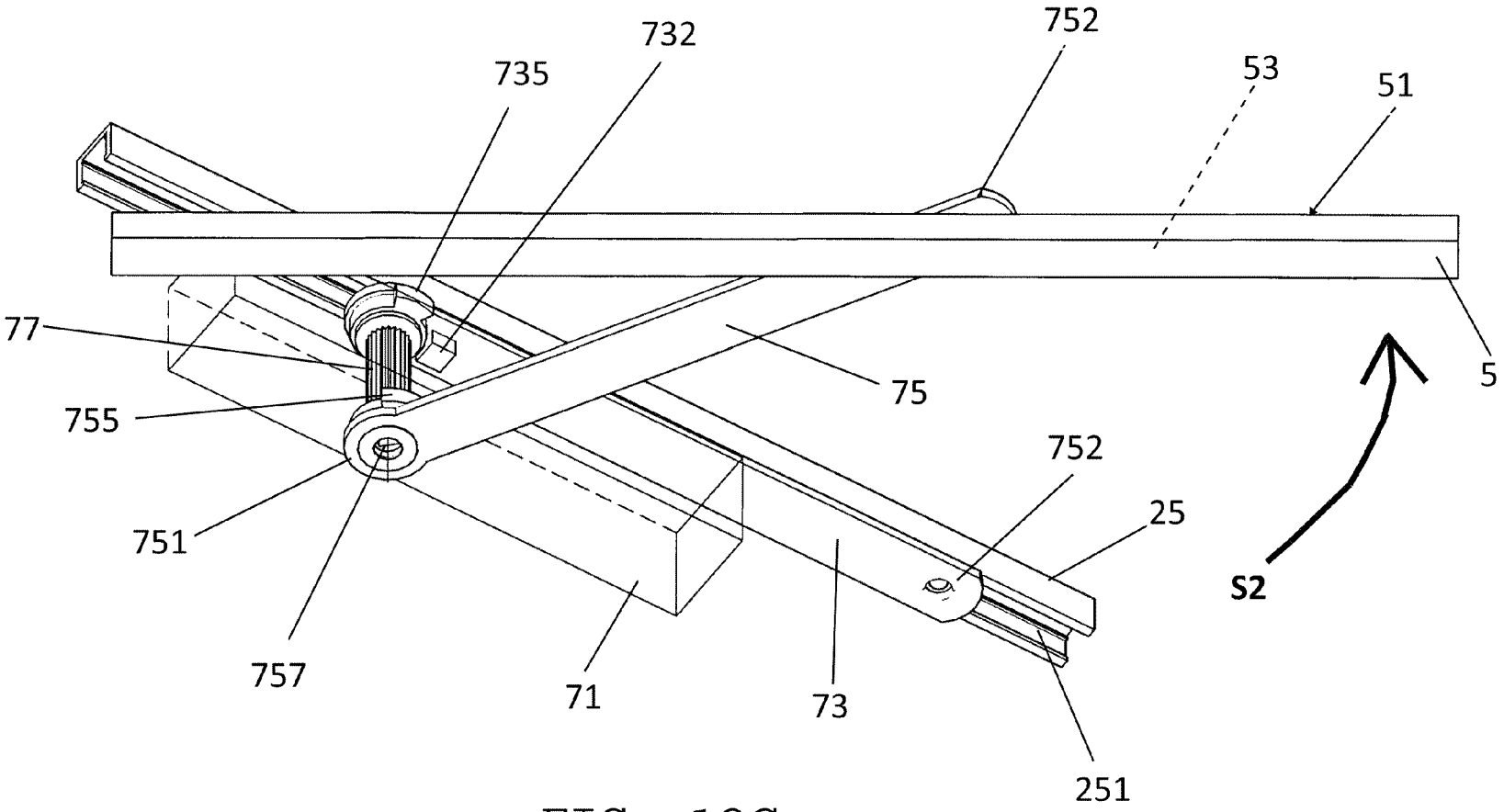
FIG. 12C is a schematic drawing of the second embodiment of the present invention, illustrating the operation of the bi-directional door closer (III).
Figure 12D:
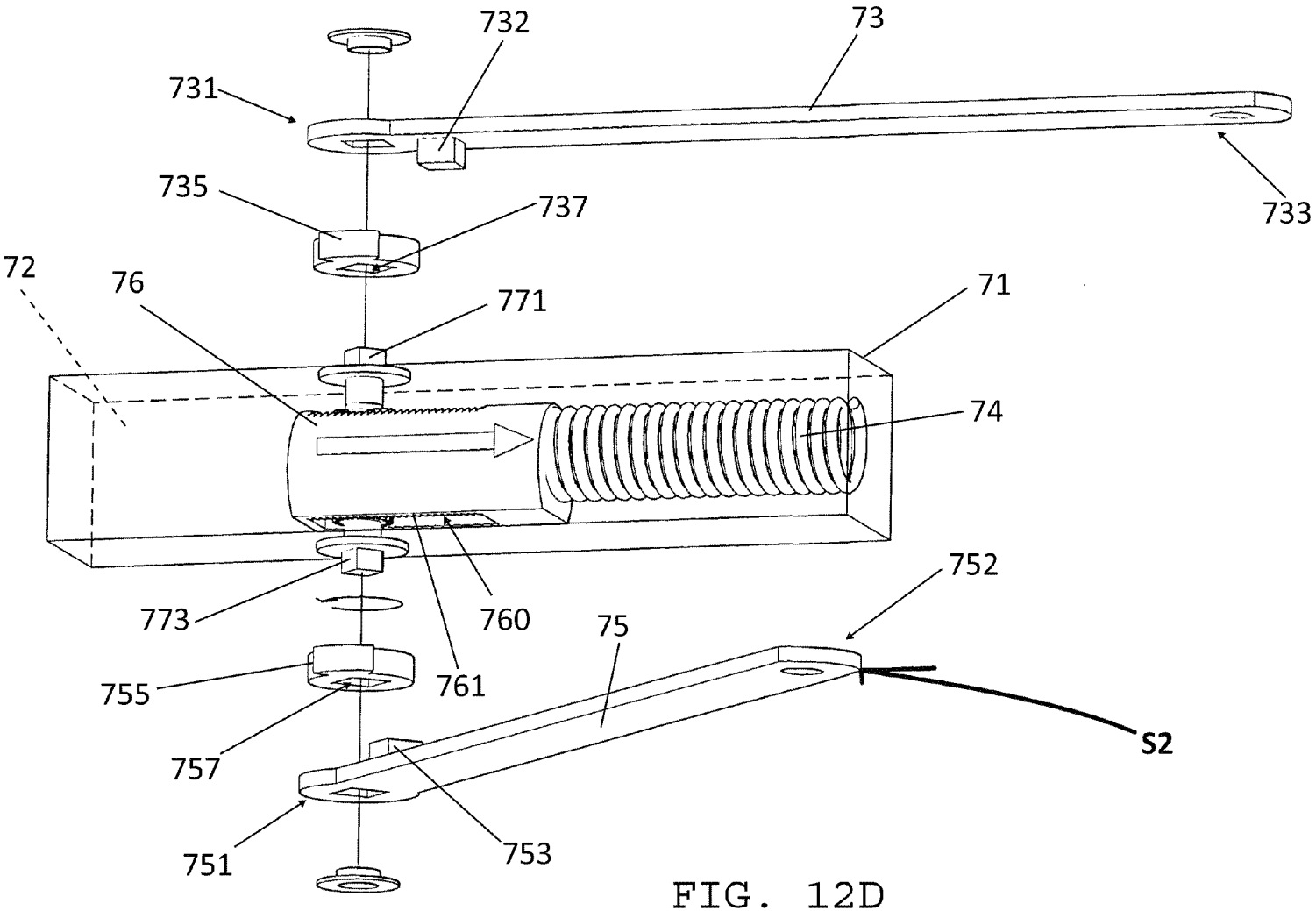
FIG. 12D is a schematic drawing of the second embodiment of the present invention, illustrating the operation of the bi-directional door closer (IV).
Figure 13:
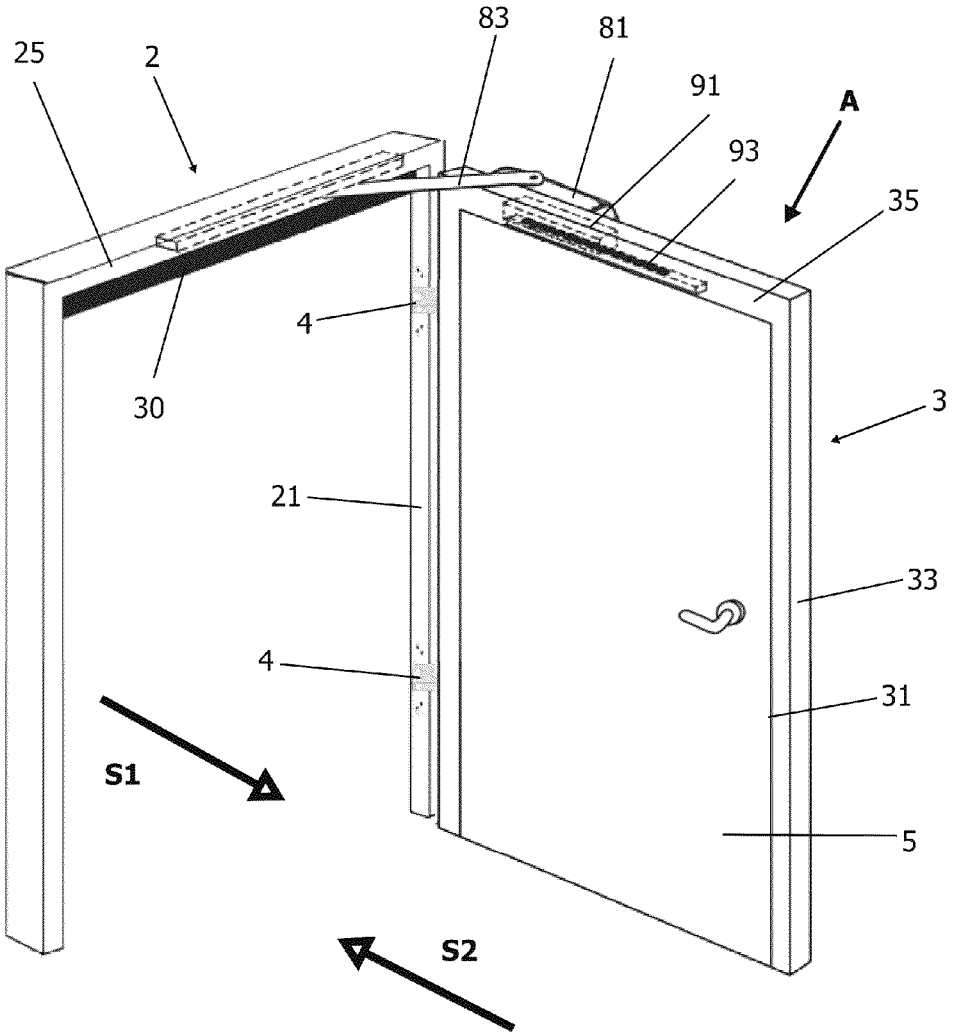
FIG. 13 is a schematic perspective view of a double-action door in accordance with a third embodiment of the present invention.

Referring to FIGS. 12C and 12D, on the contrary, when the user opens the door panel 5 in the second direction S2, the second stop block 753 of the second arm 75 is forced to stop against (engage with) the second cam 755. At this time, the shaft wheel 77 is synchronously rotated with the second cam 755 in the counter-clockwise direction to move the toothed rail 761, forcing the sliding block 76 to compress the spring member 74, and thus the spring member 74 is forced to accumulate potential energy. At the same time, the first cam 735 is disengaged from the first stop block 732, and therefore the inner door frame 3 is immovable and kept at the inner side of the outer door frame 2. When closing the door panel 5 at this time, the spring member 74 releases the accumulated potential energy to push the door panel 5 back to the inner door frame 3 to close the passage.

In this embodiment, the invention has a bi-directional door closer 7 connected to the inner door frame 3. The bi-directional door closer 7 integrates the directional first arm 73 and second arm 75 for enabling them to be respectively moved in reversed directions and linked to the outer door frame 2 and door panel 5, and thus, the bi-directional door closer 7 solves the problem of conventional double-action door. More particularly, the first cam 735 and the second cam 755 are mounted at the opposing top and bottom ends of the shaft wheel 77 to match with the first stop block 732 for moving the first arm 73 and the second stop block 753 for moving the second arm 75, thus, the single bi-directional door closer 7 controls two door panels in two reversed directions, this cooperation and competition function is similar to the working of a clutch. Under the functioning of a conventional door closer, the architecture of the present invention cannot achieve "two ways in one, i.e., push and go", i.e., the use of a conventional door closer cannot control the functioning of two reversed one-way door panels. The structural functional features of the double-action door and the bi-directional door closer 7 of the present invention are not seen in prior art designs.

Referring to 13, a double-action door in accordance with a third embodiment is shown. This third embodiment uses a first door closer 8 and a second door closer 9 to substitute for the aforesaid bi-directional door closer 7.

According to this third embodiment, the double-action door comprises an outer door frame 2 comprising an outer door frame inner edge 21 and a first top rail 25 at an upper side of the outer door frame inner edge 21, an inner door frame 3 comprising an inner door frame inner edge 31, an inner door frame outer edge 33 being smaller than the outer door frame inner edge 21 and a second top rail 35 at an upper side of the inner door frame outer edge 33, at least one, for example, two first hinges 4 connected between the outer door frame 2 and the inner door frame outer edge 33 at different elevations for enabling the inner door frame 3 to be biased relative to the outer door frame inner edge 21 in the first direction S1 between an open position and a close position, a door panel 5 comprising a door panel outer edge 51 being smaller than the inner door frame inner edge 31, and at least one, for example, two second hinges 6 connected between the inner door frame 3 and the door panel outer edge 51 at different elevations for enabling the door panel 5 to be biased relative to the inner door frame inner edge 31 in the second direction S2 between an open position and a close position.

The first door closer 8 comprises casing 81 fastened to the second top rail 35, and an arm 83 coupled to the outer door frame 2 and turnable relative to the outer door frame 2 in the first direction S1.

The second door closer 9 comprises a casing 91 fastened to the inside of the second top rail 35, and an arm 93 coupled to the door panel 5 and turnable relative to the door panel 5 in the second direction S2. The first top rail 25 defines a first sliding groove 251. The first arm 73 defines a first rear end 733 slidably coupled to the first sliding groove 251. The door panel 5 defines a second sliding groove 351 at a top side thereof. The second arm 75 defines a second rear end 752 slidably coupled to the second sliding groove 351. By means of the first door closer 8 and the second door closer 9, this third embodiment achieves the same effects as the aforesaid second embodiments.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A double-action door, comprising:

an outer door frame comprising an outer door frame inner edge and a first top rail at a top side of the outer door frame relative to said outer door frame inner edge;

an inner door frame comprising an inner door frame inner edge and a second top rail at a top side of the inner door frame to said inner door frame inner edge;

at least one first hinge connected between said outer door frame and said inner door frame for enabling said inner door frame to be turned relative to said outer door frame inner edge between an open position and a closed position in a first direction;

a door panel;

at least one second hinge connected between said inner door frame and said door panel for enabling said door panel to be turned relative to said inner door frame inner edge in a second direction reversed to said first direction between an open position and a closed position a bi-directional door closer comprising a casing fastened to said second top rail, a track chamber defined in said casing, a first arm comprising a first front end, a first stop block located at said first front end and a first rear end movably coupled to said first top rail, a second arm comprising a second front end, a second stop block located at said second front end and a second rear end movably coupled to said door panel, a shaft wheel rotatably mounted in said track chamber of said casing, said shaft wheel comprising a top end and an opposing bottom end respectively extended out of opposing top and bottom sides of said casing, a spring member mounted in said track chamber and having a first end abutting one end wall of said casing, and a sliding block stopped against a second end of said spring member in said track chamber, said sliding block comprising a toothed rail movably meshed with said shaft wheel, said first front end of said first arm being rotatably coupled to the top end of said shaft wheel adjacent to said first cam, the first stop block positioned in parallel to said first cam and movable into engagement with or apart from said first cam, said second front end of said second arm being rotatably coupled to the bottom end of said shaft wheel adjacent to said second cam, the second stop block positioned in parallel to said second cam and selectively movable into engagement with or apart from said second cam.

2. The double-action door as claimed in claim 1, wherein said sliding block further comprises an elongated slot; said toothed rail is integrally formed with a part of said sliding block at one lateral side of said elongated slot; and said shaft wheel is rotatably inserted through said elongated slot of said casing and meshed with said toothed rail.

3. The double-action door as claimed in claim 1, wherein said first top rail comprises a first sliding groove; said first rear end of said first arm is slidably coupled to said first sliding groove; said door panel comprises a second sliding groove located at a top side thereof; and said second rear end of said second arm is slidably coupled to said second sliding groove.

4. The double-action door as claimed in claim 1, wherein said first cam comprises a first axle hole fixedly connected to the top end of said shaft wheel; and said second cam comprises a second axle hole fixedly connected to the bottom end of said shaft wheel.

5. The double-action door as claimed in claim 1, wherein said at least one first hinge and said at least one second hinge are buffer hinges.

6. The double-action door as claimed in claim 1, wherein said inner door frame further comprises a stop plate located at and covered on a part of said inner door frame inner edge for stopping against said door panel.

7. The double-action door as claimed in claim 1, wherein said door panel is biased relative to said inner door frame in said second direction reversed to said first direction to form a small door.

8. The double-action door as claimed in claim 1, wherein said door panel is movable with said inner door frame relative to said outer door frame in said first direction to form with said inner door frame a large door.

9. The double-action door as claimed in claim 1, wherein said inner door frame further comprises a stop plate covered on a part of said inner door frame inner edge.

* * * * *